US005329213A

United States Patent [19]

Orton et al.

[11] Patent Number: 5,329,213

[45] Date of Patent: Jul. 12, 1994

[54] METHOD OF TURNING OFF THE RECEIVER OF A RADIO CONTROLLED MODEL

[76] Inventors: Kevin R. Orton, 940 Calle Negocio, San Clemente, Calif. 92672; Noel W. Lovisa, 3-41 Garden St., Mundingburra, Townsville 4810, State of Queensland, Australia

[21] Appl. No.: 157,508

[22] Filed: Nov. 23, 1993

Related U.S. Application Data

[63] Continuation-in-part of Ser. No. 61,918, May 14, 1993, abandoned, which is a continuation of Ser. No. 948,661, Sep. 22, 1992, Pat. No. 5,216,337, which is a continuation of Ser. No. 783,279, Oct. 28, 1991, abandoned.

[51] Int. Cl.[5] ..... H02P 3/00

[52] U.S. Cl. ..... 318/16; 318/446

[58] Field of Search ..... 318/16, 445, 446, 450, 318/453, 455, 280-286, 480, 484, 452; 340/870.19, 870.24, 870.25, 870.26, 635, 636, 648, 660; 307/9.1, 10.1, 10.6; 446/454, 456

[56] References Cited

U.S. PATENT DOCUMENTS

| | | | |
|---|---|---|---|
| 4,143,307 | 3/1979 | Hansen et al. | 318/16 |
| 4,236,594 | 12/1980 | Ramsperger | 307/10.6 X |
| 4,360,808 | 11/1982 | Smith, III et al. | 340/825.69 |
| 5,103,146 | 4/1992 | Hoffman | 318/16 |
| 5,134,347 | 7/1992 | Koleda | 318/16 |
| 5,216,337 | 6/1993 | Orton et al. | 318/16 |
| 5,218,276 | 6/1993 | Yoem et al. | 318/16 |

*Primary Examiner*—Jonathan Wysocki
*Attorney, Agent, or Firm*—Loyal M. Hanson

[57] ABSTRACT

A method of turning off the receiver of a radio controlled model includes the step of providing a speed controller with control circuitry for receiving setpoint information from a receiver that represents manipulation of a throttle trigger on an R/C transmitter unit and for automatically turning the receiver off upon the occurrence of a predefined pattern of setpoint information. The method proceeds by monitoring the throttle trigger setpoint information with the control circuitry, detecting with the control circuitry the occurrence of the predefined pattern of the throttle trigger setpoint information, and turning off the receiver with the control circuitry upon the occurrence of the predefined pattern of throttle trigger setpoint information. One preferred form of the invention includes a speed controller with microprocessor circuitry that is programmed to turn off the receiver upon the occurrence of throttle trigger setpoint information that represents the throttle trigger being held rearward for five seconds or more followed by the transmitter unit being turned off.

4 Claims, 4 Drawing Sheets

METHOD OF TURNING OFF THE RECEIVER OF A RADIO CONTROLLED MODEL

CROSS REFERENCE TO RELATED APPLICATION

This application is a continuation-in-part of U.S. patent application Ser. No. 08/061,918 filed May 14, 1993 now abandoned which is a continuation of U.S. patent application Ser. No. 948,661 filed Sep. 22, 1992 now U.S. Pat. No. 5,216,337, which is a continuation of U.S. patent application Ser. No. 783,279 filed Oct. 28, 1991 now abandoned.

BACKGROUND OF THE INVENTION

Technical Field

This invention relates generally to radio controlled (R/C) models, and more particularly to a method of turning off the receiver off an R/C model.

Background Information

Recall that the drive motor of a radio controlled model operates under control of an onboard control module called an R/C speed controller . . . or just speed controller. The speed controller includes circuitry that controls the drive motor according to throttle-trigger setpoint information received by a miniature onboard receiver. The R/C enthusiast manipulates a throttle trigger on a handheld transmitter unit to produce that setpoint information (moving it forward from a neutral position for throttle setpoint information and rearward from the neutral position for braking setpoint information). The transmitter unit communicates that setpoint information to the speed controller via the onboard receiver over a specified channel, and the speed controller controls the drive motor accordingly.

The transmitter unit usually also communicates other setpoint information to any of various R/C servomechanisms via the onboard receiver over other specified channels. It may, for example, communicate steering setpoint information over a second channel to a steering servo. The operator manipulates a steering control on the handheld transmitter unit to produce the steering setpoint information, the transmitter unit communicates it to the steering servo via the onboard receiver over the second channel, and the steering servo controls the steering linkage of the R/C model accordingly.

Then, after a race or other period of operation, the operator approaches the R/C model to manually actuate an on-off switch on the speed controller in order to turn the receiver off. Doing so right away is often important because it conserves precious battery power. In addition, it frees the frequency for use by another operator. Furthermore, it prevents undesired operation in response to noise or other signals from other nearby transmitters that the receiver picks up.

But turning the speed controller off right away may be somewhat inconvenient. At a racing event, for example, the operator may be positioned at an operator's stand some distance from the model. He must first move down from the operator's stand, approach the model, and then manually actuate an on-off switch. Doing so can be time consuming and inconvenient. He is not able to use the transmitter for that purpose because existing transmitter units do not have the capability to send a separate or distinct signal to indicate that the receiver should be turned off. Furthermore, the expense of providing a transmitter channel for that purpose may be prohibitive. So, R/C enthusiasts need a better way to turn the receiver off.

SUMMARY OF THE INVENTION

This invention solves the problems outlined above by configuring the speed controller to recognize a predefined pattern of throttle trigger manipulation as a turn-off command. In other words, it recognizes a predefined pattern of throttle trigger setpoint information as a turn-off command. Thus, the invention works with existing R/C transmitter units. It avoids the need for a separate turnoff signal and an additional channel for communicating the turnoff command. The operator need only manipulate the throttle trigger as required to produce the predefined pattern.

The predefined pattern of setpoint information is one that usually does not occur in normal R/C model operation. It may for example, correspond to the throttle trigger being held rearward in the full braking position for five seconds or more followed by cessation of the transmitter signal communicating that setpoint information. The operator produces that braking setpoint information with an existing transmitting unit by holding the throttle trigger in the rearward position for five seconds and then turning the transmitter unit off. Upon detecting the occurrence of that pattern, the speed controller automatically turns the receiver off. It does so any of suitable known switching techniques, such as a semiconductor switch, for example, that switches off the power to the receiver. The controller may also turn itself off.

In terms of the claim language, a method of turning off the receiver of an R/C model includes the step of providing a speed controller with control circuitry for receiving setpoint information from a receiver that represents manipulation of a throttle trigger on an R/C transmitter unit and for automatically turning the receiver off upon the occurrence of a predefined pattern of setpoint information. The method proceeds by monitoring the throttle trigger setpoint information with the control circuitry, detecting with the control circuitry the occurrence of the predefined pattern of the throttle trigger setpoint information, and turning off the receiver with the control circuitry upon the occurrence of the predefined pattern of throttle trigger setpoint information. One preferred form of the invention includes a speed controller with microprocessor circuitry that is programmed to turn off the receiver upon the occurrence of throttle trigger setpoint information that represents the throttle trigger being held rearward for five seconds or more followed by the transmitter unit being turned off.

In line with the above, an R/C speed controller constructed according to the invention includes a module adapted to be mounted in a radio controlled model having a motor, a battery, and a receiver. The module includes control circuitry adapted to be connected to the motor, the battery, and the receiver for coupling power from the battery to the motor under program control according to throttle trigger setpoint information received by the receiver. The control circuitry also includes switching circuitry for turning off power to the receiver, and the control circuitry is configured to turn off the receiver in response to a predefined pattern of throttle trigger setpoint information. The following detailed description and illustrative drawings make the foregoing and other objects, features, and advantages of the invention more apparent.

DESCRIPTION OF THE PREFERRED EMBODIMENTS

By way of background, the following description restates descriptive material contained in the parent application (Ser. No. 948,661 which issued Jun. 1, 1993 as U.S. Pat. No. 5,216,337). The background information is followed by further details of the remote receiver turnoff feature. Thus, the description proceeds according to the following outline:

1. Overview
2. Miniature Keypad
3. Drive Circuit
4. Brake Circuit
5. Programming Overview
6. Operation
7. Remote Receiver Turnoff One already familiar with the parent application may turn directly to the Remote Receiver Turnoff section for the details it provides.

Overview

Figure 1:
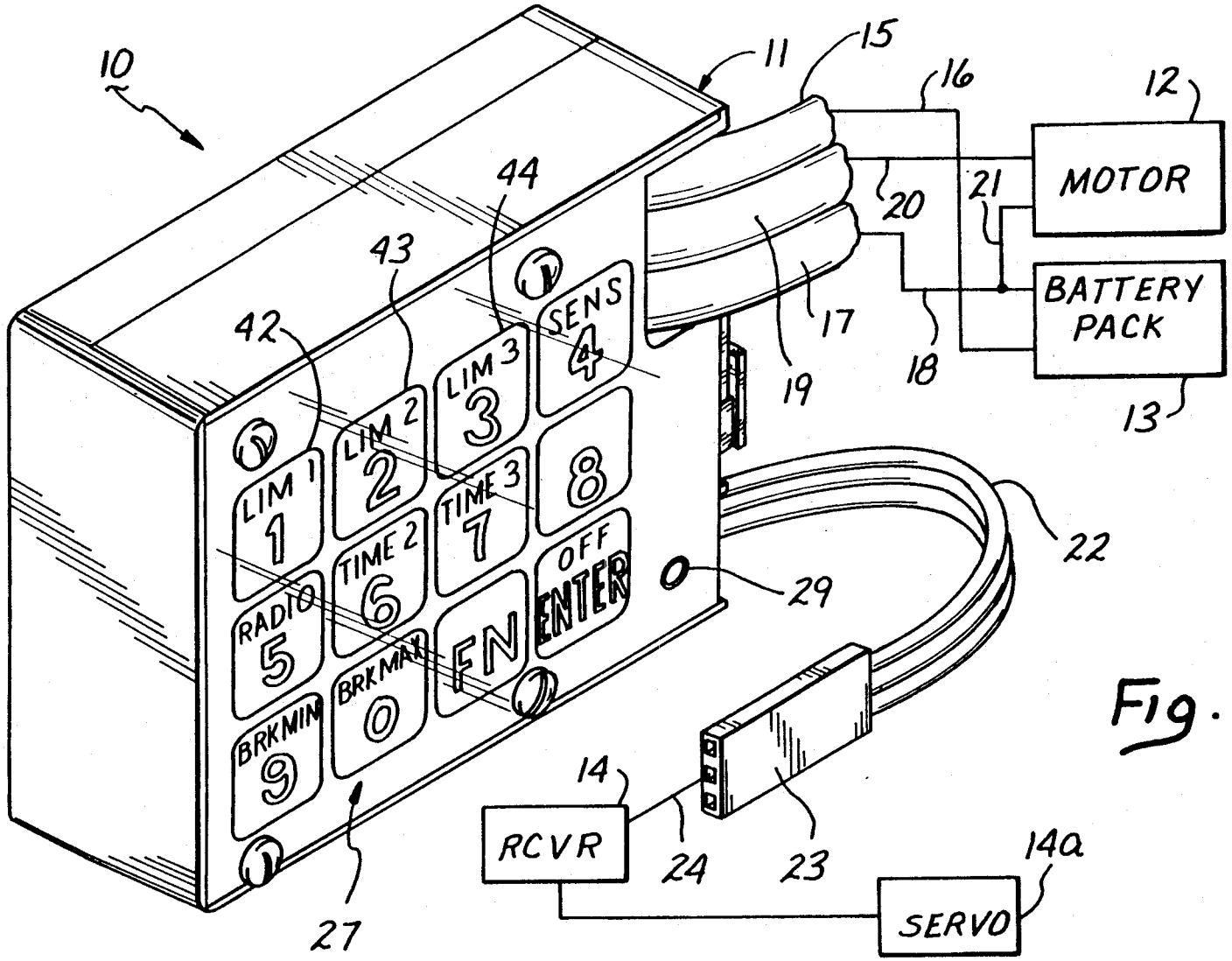
FIG. 1 of the drawings is a pictorial of an R/C speed controller constructed according to the invention.

FIG. 1 of the drawings shows one version of a R/C speed controller 10 constructed according to the invention. Generally, it includes a module 11 (a housing) that houses and supports control circuitry. The module 11 is suitably small to be mounted on a conventional radio controlled model (e.g., it may measure about 4.0 cm by 3.5 cm by 1.5 cm) and the control circuitry is miniaturized sufficiently to fit on the module 11 (the term "on" also meaning "within" the module 11). The module 11 may mount on the model by known means (e.g., double-backed adhesive tape or screws) and it serves the function of housing and supporting the various electronic circuit components of the speed controller circuitry that are subsequently described in further detail with reference to FIG. 2.

Suitable wiring electrically connects the control circuitry to a motor 12, a battery 13, and a receiver 14 on the radio controlled model (FIG. 1). A steering servo **14*a* is connected in a known way by suitable cabling to the receiver 14. A wire 15 connects the control circuitry to one terminal of the battery 13 as depicted by a line 16. A wire 17 connects it to the other terminal of the battery 13 as depicted by a line 18. A wire 19 connects it to one terminal of the motor 12 as depicted by a line 20, and the other terminal of the motor 12 is connected to the same terminal of the battery 13 as depicted by a line 21**.

In addition, a three-wire cable 22 terminating in a connector 23 connects the control circuitry to the receiver 14 as depicted by a line 24. Two wires in the cable provide battery power to the receiver 14 while the third wire couples a signal from the receiver 14 to the control circuitry. Of course, the wires 15, 17, and 19 may also include connectors, but some operators find it advantageous to solder those wires directly to terminals on the motor 12 and battery 13 for better conductivity and thereby better efficiency.

Figure 2:
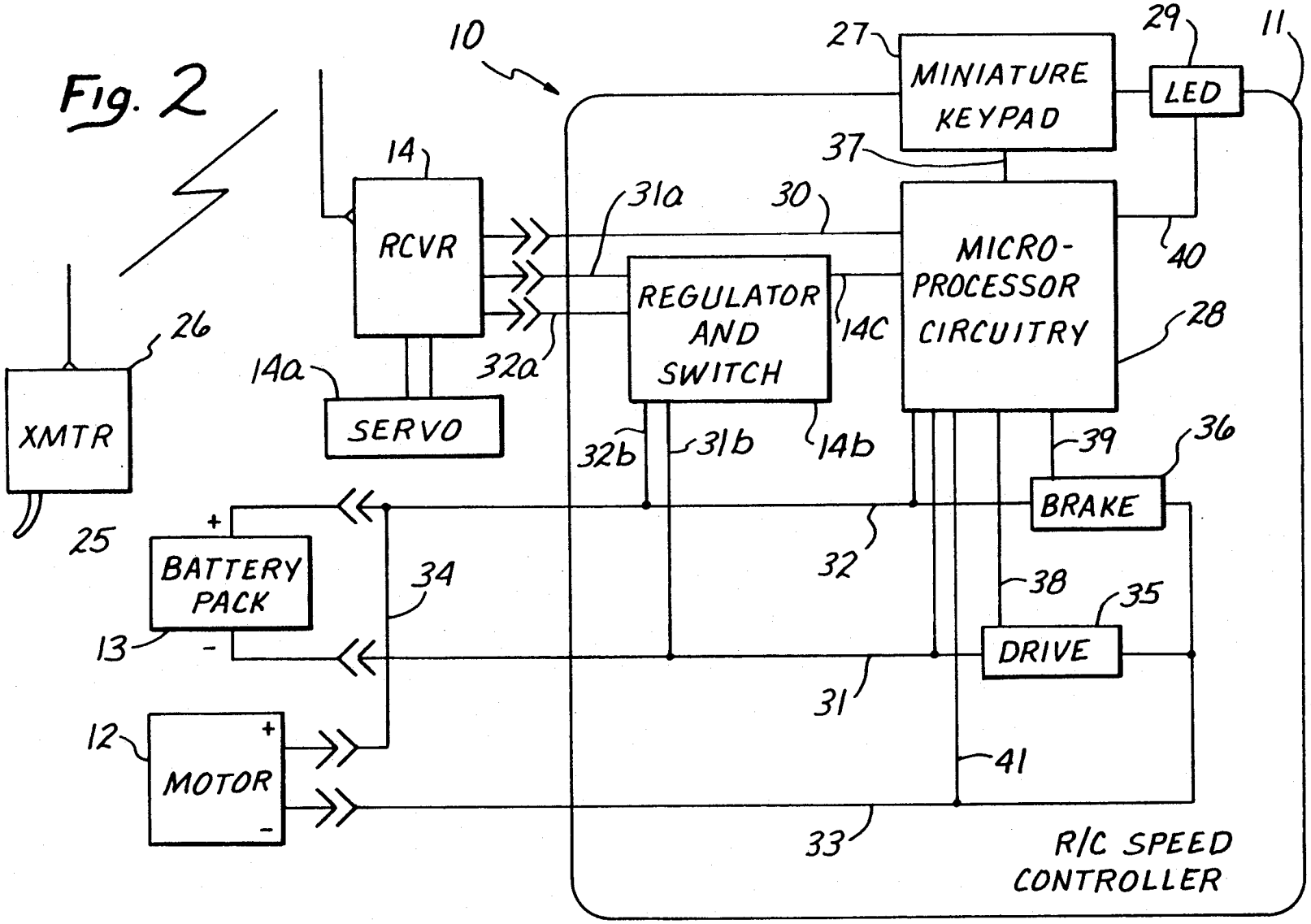
FIG. 2 is a block circuit diagram of the speed controller connected to a motor, a battery pack, and a receiver for operation in an R/C model car.

The speed controller 10 operates conventionally in some respects in the sense that it couples power from the battery 13 to the motor 12 according to setpoint information received by the receiver 14 (i.e., throttle trigger setpoint information). That enables an operator to remotely control a model in which the controller 10 is installed by manipulating throttle trigger 25 or other setpoint input device (e.g., a steering control) on a conventional handheld transmitter unit 26 (FIG. 2). Doing so causes the transmitter unit 26 to transmit setpoint information to the speed controller 10 via the onboard receiver 14 and that results in the speed controller 10 controlling the motor 12 (and/or steering linkages) accordingly. For purposes of steering, the receiver 14 couples steering set point information to the steering servo **14*a*, and the steering servo 14*a* responds in a known way to control steering linkages that are not shown separately, but may be considered part of the servo 14*a*** for purposes of this description.

The speed controller 10 includes a keypad 27 mounted on the module 11 (FIGS. 1 and 2). It combines with microprocessor circuitry 28 (FIG. 2) to facilitate operation by enabling convenient and repeatable direct entry of various operating parameters without the need to fine tuning potentiometers. As a part of that operation, the speed controller 10 produces a visually discernible feedback signal with a light emitting diode illustrated as an LED 29 (FIGS. 1 and 2). It is also configured, according to the invention described in the parent application, to produce an audibly discernible feedback signal without using a conventional acoustic transducer by producing audible mechanical vibrations with high current pulses.

Considering the control circuitry in further detail with reference to FIG. 2, it includes a receiver line 30 (connected to the third wire in the cable 22 of FIG. 1), positive and negative power lines **31*a* and 32*a* (also connected to the cable 22 in FIG. 1, first and second battery lines 31 and 32 (connected to the wires 15 and 17 in FIG. 1), and a motor line 33 (connected to the wire 19 in FIG. 1). Those are electrically conductive lines and they connect to the receiver 14, the motor 12, and the battery 13** by means of the wiring shown in FIG. 1 (e.g., with connectors or soldering).

The receiver line 30 connects in a conventional manner to a control-signal output of the receiver 14 over which throttle trigger setpoint information is sent to the control circuitry. The first and second battery lines 31 and 32 connect to first and second terminals of the battery 13. The also connect via lines **31*b* and 31*b* to a regulator and switch circuit 14*b***.

The circuit **14*b* includes suitable components to provide regulated 5.5 volts to the receiver 14 over the lines 31*a* and 32*a*. It also includes suitable components, such as a semiconductor switch, for example, for turning off power to the receiver 14 under control of the microprocessor circuitry 28. A line 14*c* couples a turnoff signal from the microprocessor circuitry 28 to the regulator and switch circuit 14*b* for that purpose. The motor line 33 connects to a first terminal of the motor 12, and a line 34 connects the second terminal of the motor 12 to the second terminal of the battery 13 (directly or by connection to the second battery line 32**).

Figure 3:
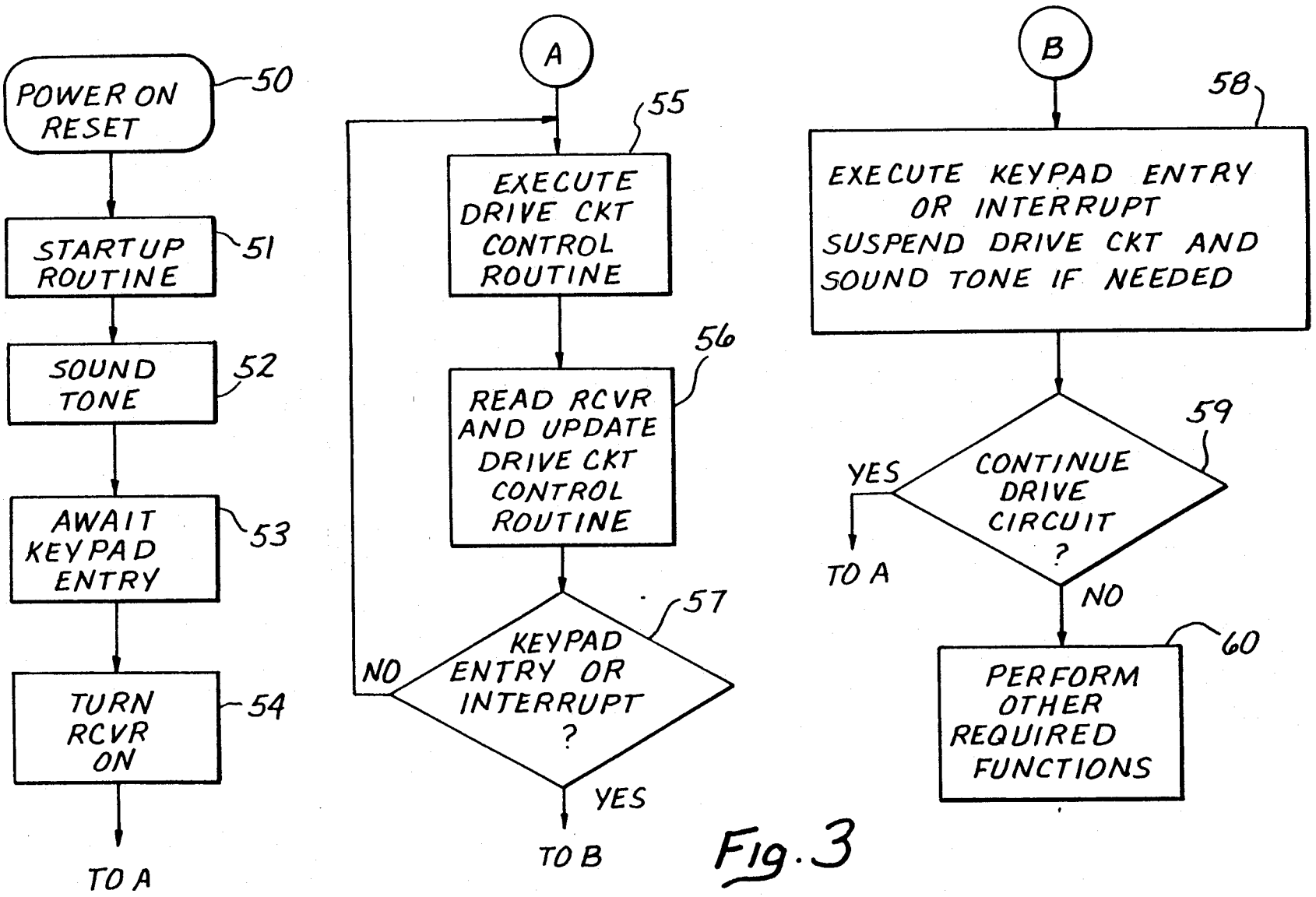
FIG. 3 is a high level flow chart of the programming employed.

The control circuitry includes a drive circuit 35 and a brake circuit 36 (FIG. 3). The drive circuit 35 is connected between the first battery line 31 and the motor line 33. There, it controls the flow of current between the battery 13 and the motor 12 by providing a switchable low impedance path. It switches under control of the microprocessor circuitry 28 between an ON state in which it couples the first battery line 31 to the motor line 33 and an OFF state in which it decouples the first battery line 31 from the motor line 33. Although the illustrated embodiment includes a drive circuit in the negative lead, it is within the inventive concepts disclosed to control the positive lead instead.

The brake circuit 26 is connected between the motor line 33 and the second battery line 32. There, it facilitates deceleration of the motor 12 by providing a switchable low impedance path for flyback current. It switches under control of the microprocessor circuitry 28 between a first brake circuit state in which it couples the motor line 33 to the second battery line 32 and a second brake circuit state in which it decouples the second battery line 32 from the motor line 33. The brake circuit 36 may be omitted for some applications (e.g., in model aircraft R/C controllers).

The microprocessor circuitry 28 is coupled to the first and second battery lines 31 and 31 for power. It is coupled to the receiver line 30 for receiving the setpoint information, and it is coupled by a line 37 to the keypad 27 in order to respond to keypad entries. A control line 38 couples a drive circuit control signal from the microprocessor circuitry 28 to the drive circuit 35, a control line 39 couples a brake circuit control signal to the brake circuit 36, and a control line 40 couples power under microprocessor control to the LED 29. In addition, a line 41 connects the motor line 33 to the microprocessor circuitry 28 so that the microprocessor can monitor the voltage on that line.

Interconnected that way, the microprocessor circuitry 28 performs the function of switching the drive circuit 35 and the brake circuit 36 under program control according to throttle trigger setpoint information received on the receiver line 30. For that purpose, the microprocessor circuitry 28 includes suitable digital circuitry (e.g., a microprocessor or microcontroller and known associated componentry). It may include, for example, a central processor, memory, input and output circuitry, power supply components, a clock, an analog-to-digital converter, and any of other various known analog and digital components configured according to known techniques to perform as subsequently described. In addition, it includes programming configured according to known programming techniques to perform as described.

The individual components and the precise programming employed in the illustrated embodiment for drive and brake control are not specified in further detail. Those things are well within the capabilities of one of reasonable skill in the art based upon the descriptions provided. The precise configuration may vary significantly according to individual preferences. By way of example, however, the microprocessor circuitry 28 may include the microcontroller chip available from Motorola that is identified by part number 68HC705P9, as well as known associated componentry, and it may be programmed using known techniques.

The line 38 couples the drive circuit control signal from the microprocessor circuitry 28 to the drive circuit 35, and the line 39 couples the brake circuit control signal from the microprocessor circuitry 28 to the brake circuit 36. The microprocessor circuitry 26 is programmed to produce the drive circuit control signal and the brake circuit control signal according to throttle trigger setpoint information received on the receiver line 30 in order to switch the drive circuit 35 and the brake circuit 36 at the appropriate times to cause the motor 12 to operate as desired.

In addition, the microprocessor circuitry 28 is programmed to produce an audible feedback signal by cycling the drive circuit between the ON state and the OFF state at an audible rate and a duty ratio sufficiently small to avoid normal motor operation. To accomplish that, it produces a drive circuit control signal on the line 38 with suitable timing. It does so for a controlled period of time so that current flowing through the drive circuit 35 causes audibly discernible mechanical vibration of at least one of the drive circuit 35, battery componentry connected to the first and second battery lines (i.e., the battery 13 and associated wiring), and motor componentry connected to the second battery line and the motor line (i.e., the motor 12 and associated wiring) as an audible feedback signal. Varying the controlled period of time and switching frequency produces musical notes, chimes, and so forth that signify various events, such as turnon, turnoff, initialization, keypad entries, and so forth.

To further appreciate. the technique employed, recall that the microprocessor circuitry 28 is programmed to produce normal motor operation in response to throttle trigger setpoint information received from the receiver 14. The setpoint information reflects the position of the throttle trigger 25 to indicate desired motor speed and braking action. It varies over a range extending from a high brake circuit endpoint value (throttle trigger pushed fully forward for maximum braking) to a high drive circuit endpoint value (throttle trigger pulled fully rearward for maximum motor speed). Intermediate those endpoints is a neutral setpoint corresponding to the throttle trigger 25 being in a neutral position intermediate the fully forward and fully rearward position (the throttle trigger 25 is spring biased in that neutral position).

To produce normal motor operation, the microprocessor circuitry 28 cycles the drive circuit 35 between the ON state and the OFF state in a series of cycles at a predetermined rate (e.g., 3 KHz) and a duty ratio corresponding to the setpoint information. The duty ratio for a particular cycle is the ratio of time the drive circuit 35 is in the ON state to the sum of that time and the time it is in the OFF state. When the operator pulls the throttle trigger 25 rearwardly from the neutral position just enough to vary the setpoint a predetermined incremental amount (e.g., 6% of the distance between the neutral and the fully rearward positions), the microprocessor circuitry 28 cycles the drive circuit at a low end drive circuit duty ratio of six percent (corresponding to about 20 microseconds in the ON state). The microprocessor circuitry 28 ignores the first six percent of throttle trigger movement because a drive circuit duty ratio below six percent does not normally produce sufficient torque in the motor. As the throttle trigger 25 is pulled further rearwardly to the fully rearward position, the microprocessor circuitry 28 increases the duty ratio accordingly, to a maximum of one hundred percent for the fully rearward position (drive circuit continually in the ON state). Normal motor operation (i.e., sufficient torque to drive the model car wheels) occurs between those points.

To produce an audible signal for feedback purposes, the microprocessor circuitry 28 cycles the drive circuit 35 between the ON state and the OFF state without regard to the setpoint information. It does so at an audible rate and a duty ratio sufficiently small to avoid much, if any, normal motor operation. For that purpose, the duty ratio is preferably set below 6% (less than 20 microseconds in the ON state) and the switching rate is set at other than 3 KHz (e.g., 500–2,000 Hz). Of course, the duty ratio may be set somewhat higher for feedback signal purposes within the inventive concepts disclosed (e.g., 9–10%), although a small (but tolerable) amount of motor operation may then result.

As the drive circuit is cycled that way, 30–50 ampere current pulses flowing during the ON state. That is sufficient to cause audibly discernible mechanical vibration of various circuit components, including at least one of the motor armature, motor wiring, battery wiring, and land patterns on a circuit board on which the control circuitry is mounted. The drive circuit 35 is cycled for a controlled period of time (e.g., one-half second for a beep and longer for various musical notes, chimes, and so forth). Varying the rate varies the tone of the feedback signal, varying the period of time the drive circuit 35 is in the ON state varies the intensity, and the microprocessor circuitry 28 is programmed to vary those parameters to produce a desired audible feedback signal.

One way the speed controller 10 uses the audible feedback signal is to signify successful completion of an initializing sequence undertaken when power is first applied. The microprocessor circuitry 28 is suitable arranged, interconnected, and programmed to perform the initializing sequence when the operator first connects the battery 13 to the speed controller 10. In other words, the microprocessor circuitry 28 starts up automatically, and in the process it initializes various program parameters. Once that is completed successfully, the microprocessor circuitry 28 produces an audible feedback signal. That way, the operator knows that transients or other disturbances during battery connection have not defeated the initializing sequence.

Another way the speed controller 10 uses the audible feedback signal is to signify successful keypad entries. The keypad 27 includes at least three keys (such as those designated keys 42–44 in FIG. 1) and preferably the twelve keys illustrated. The microprocessor circuitry 28 is programmed to produce an audible signal when anyone of the keys is depressed to signify a successful keypad entry. Of course, the microprocessor circuitry 28 may be programmed to produce an audible feedback signal signifying any of various other events.

Considering the brake circuit 36 in further detail, it provides a path for current flow in the absence of the motor 12. For that purpose, the microprocessor circuitry 28 is programmed to switch the brake circuit 36 to the first brake circuit state during the controlled period of time it cycles the drive circuit for feedback signal generation purposes. Further details of construction and operation follow.

Miniature Keypad

With further regard to the keypad 27, it is part of the microprocessor circuitry 28 and occupies an accessible position on the module 11 so that an operator can input information by depressing various keys. Of course, the keypad 27 can be a separate component that connects to the module 11 during keypad use without departing from the invention. An operator depresses various ones of the keys to input information to the microprocessor circuitry 28, such as setup and operating parameters.

As an example of keyboard construction, the keypad 27 may take the form of a clear plastic membrane (such as the material available under the trademark MYLAR) on which the various indicia shown in FIG. 1 are printed. The membrane includes a conductive silver ink printed on the reverse side (the side facing away from the operator). When a key is depressed, the silver ink contacts two printed circuit board traces associated with the particular key that was depressed. That shorts the two traces together so that they function as the two contacts of a single-pole-single-throw switch for that particular key. Of course, other keypad arrangements may be employed within the inventive concept disclosed of outfitting an R/C speed controller with a keypad and microprocessor circuitry in order to significantly facilitate operation.

Drive Circuit

The drive circuit 35 includes one or more semiconductor devices capable of switching the current supplied by the battery 13 to the motor 12. It may use, for example, a bank of several parallel-connected MOSFET devices, such as those available from Siliconix that are identified by part number SMP60N05.

The drive circuit 35 is conventional in some respects in the sense that it operates to switch current flowing between the battery 13 and the motor 12. It does so under program control, however, and according to information inputted with the keypad 27. It switches the drive circuit 35 under program control to cause pulses of current of desired duration and repetition rate to flow to the motor 12. The microprocessor circuitry 28 varies the duration and repetition rate to achieve the desired current flow. In that way, it controls the flow of battery power to the motor 12 and thereby controls motor operation accordingly. In addition, it enables other inventive functions to be accomplished.

Brake Circuit

The brake circuit 36 includes one or more semiconductor devices for shorting the motor terminals together for braking purposes. They are capable of switching the amount of current that flows. The illustrated brake circuit 36 employs two parallel-connected MOSFET devices, such as the Siliconix SMP60N05 devices previously described for the drive circuit 35.

The brake circuit 36 is conventional in some respects in that it operates to decelerate the motor 12. It provides a switchable low impedance path between the motor terminals. However, it does so under program control. The microprocessor circuitry 28 switches the brake circuit 36 to the first brake circuit state to load the motor 12 and thereby decelerate it. In the absence of the low impedance path provided by the brake circuit 36, the motor 12 freewheels when the drive circuit 35 is in the OFF state and only coasts to a stop.

Programming

FIG. 3 is a high level flow chart of the programming employed. When a battery pack is connected to the speed controller 10, the microprocessor circuitry resets at block 50 and goes to a startup routine (an initialization routine) at 51 in which it sets various program parameters, flags, and so forth. After initialization, the programming sounds a tone at 52 in the manner previously described to signify successful completion of the initialization routine. Then, it loops at block 53 while awaiting a keypad entry.

When a keypad entry is detected at block 53, the programming turns on the receiver 14 at block 54, bit suitably activating the regulator and switch circuit **14*b* in FIG. 2, and executes a drive circuit control routine at block 55. The drive circuit control routine turns the drive circuit 35 on and off according to throttle trigger setpoint information received from the receiver 14. The programming reads the throttle trigger setpoint information at block 56** and updates the drive circuit control routine. That way, the updated throttle trigger setpoint information applies the next time the drive circuit control routine is executed. Changes in the throttle trigger setpoint information may occur every ten milliseconds or so.

The programming then checks for a keypad entry or an interrupt. If there are none, it re-executes the drive circuit control routine according to the updated throttle trigger setpoint information. If a keypad entry or an interrupt is detected, the programming executes according to the keypad entry or interrupt at block 58. As a part of that routine, it suspends drive circuit operation and sounds a tone to signify that a keypad entry has been made and to signify various operations in the interrupt routines.

Once the keypad entry or interrupt has been serviced, the programming determines at block 59 whether to continue drive circuit operation. That decision may depend on the keypad entry or interrupt. If yes, the programming goes back to the drive circuit control routine at block 55. If no, it performs other functions, such as setting new operating parameters according to a keypad entry just serviced, and so forth.

Operation

Operation involves connecting the battery 13. When that is done, the speed controller 10 performs the initializing sequence previously described and produces a tone (i.e., a feedback signal). Then, the operator makes keypad entries using the keypad 27 to set various operating parameters. Although key layout and operation may take any of various forms within the broader inventive concepts disclosed, the layout shown in FIG. 1 combines with inventive programming to provide significant functionality in speed controller 10.

The LIM 1, LIM 2, and LIM 3 keys input desired limits on the current supplied by the battery 13 (from 0 to 9999 amperes). They also input the digits "1," "2," and "3." The LIM 1 value applies at the start of operations. The LIM 2 and LIM 3 limits apply the number of seconds after the start of operations entered with the TIME 2 and TIME 3 keys. The TIME 2 and TIME 3 keys are also used to input the digits "6" and "7."

The SENS key inputs throttle sensitivity information and the digit "4." The RADIO key is used for calibrating the receiver 14 (i.e., causing the microprocessor circuitry 28 to adjust to the characteristics of the receiver 14 and transmitter 26) and for inputting the digit "5." In that regard, existing R/C transmitter units usually use control information encoded on a carrier by pulse width modulation. A pulse width of one millisecond typically represents a full brake position of the throttle 22 and a pulse width of two milliseconds represents a full throttle position. The RADIO key enables an operator to adjust the microprocessor circuitry 28 to the characteristics of the command signal from the receiver 14 and transmitter 26 regarding the full brake and full throttle positions.

The 8 key inputs the digit "8". The BRK MIN and BRK MAX keys input braking characteristics information and the digits "9" and "0." The FN key selects the function mode so that the next key depressed will specify its function rather than a digit, and the OFF ENTER key serves to enter the information represented by the keys depressed. It also serves to turn off various circuits.

To calibrate the receiver 14, the operator turns the transmitter 26 on and presses the FN key followed by the RADIO key. Next, the operator moves the throttle 25 on the transmitter 26 between the maximum throttle and maximum brake positions a couple of times and leaves it in the neutral position. Then the operator presses the OFF ENTER key.

To set a current limit, press the FN key followed by the LIM 1, LIM 2, or LIM 3 key. Next, enter the desired current limit between 0 and 9999 amperes by depressing the appropriate keys. Then press the OFF ENTER key. To set the time the second or third limit is to apply, press the FN key followed by the TIME 2 or the TIME 3 key. Next, enter the desired time in seconds by depressing the appropriate keys. Then press the OFF ENTER key.

The microprocessor circuitry 28 considers the race start to be the instant the throttle trigger 25 is moved to the full throttle position for the first time after the speed controller 10 has been reset. The microprocessor circuitry 28 bases all timing on that start point. Turning the speed controller 10 on or changing the current limits or times also resets the speed controller 10. The OFF ENTER key can be depressed at the end of a race to turn the speed controller 10 off.

Remote Receiver Turnoff

Figure 4:
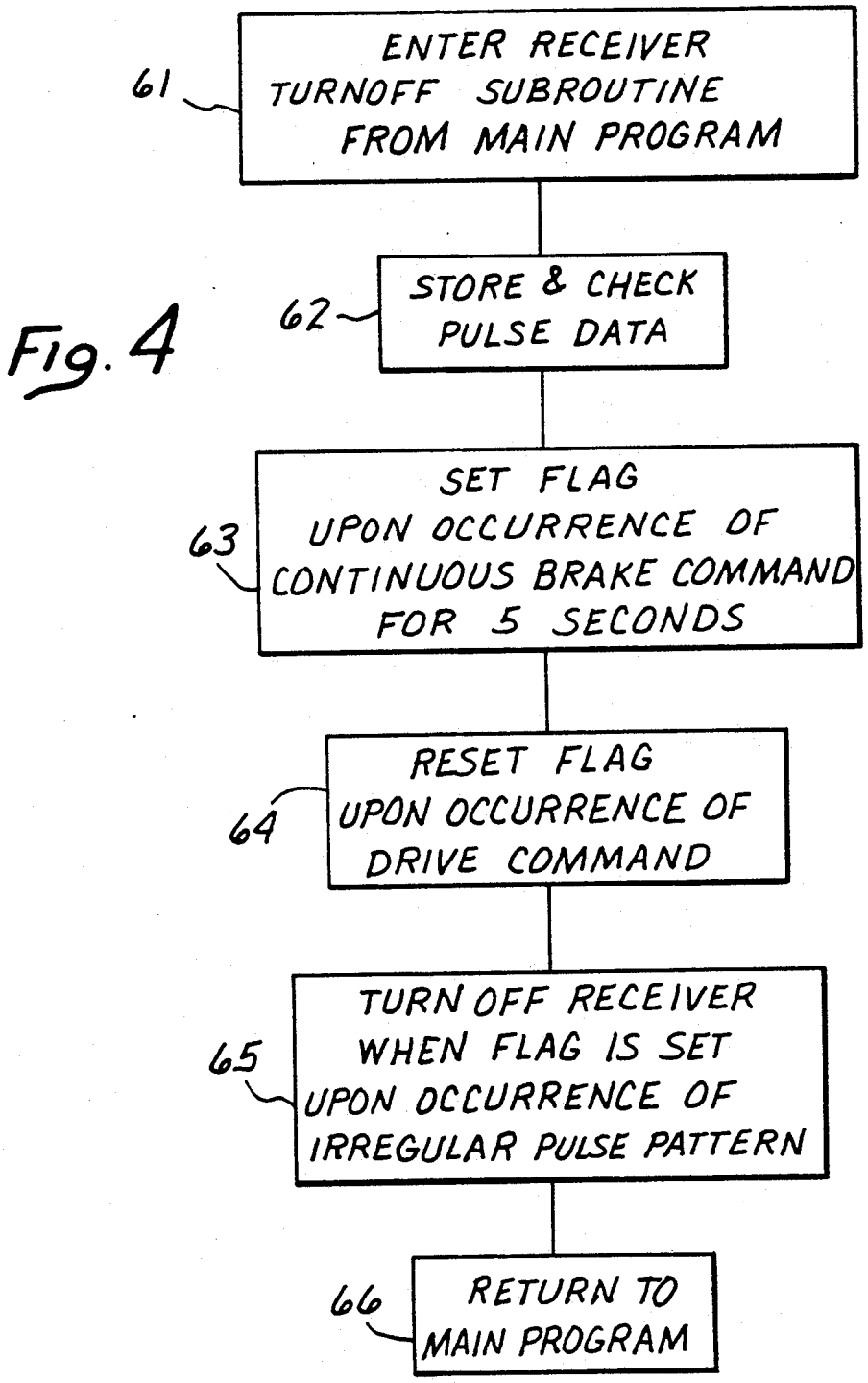
FIG. 4 is a block diagram of the receiver turnoff subroutine.

Now consider the block diagram in FIG. 4. It shows various logical operations performed by the microprocessor circuitry 28 relative to turning off the receiver 14 in response to a predefined pattern of throttle trigger setpoint information. It may be called a receiver turnoff subroutine, and one of ordinary skill in the programming art may implement the functions described using known programming techniques.

The receiver turnoff routine begins at block 61 in FIG. 4. It is a portion of the main program at block 56 in FIG. 3. In other words, in reading the receiver and updating the drive circuit control routine in block 56 as previously described, the programming branches to the receiver turnoff routine beginning at block 61 in FIG. 4.

As indicated at block 62, the subroutine stores the current pulse (i.e., data about the current pulse) in PULSE DATA. PULSE DATA includes pulse data about pulses occurring (i.e., received by the microprocessor from the receiver) over for a predetermined sample period, such as 250 milliseconds (ms), for example. In other words, PULSE DATA includes data about the current pulse as well as data about the pulses that occurred during the previous 250 ms.

In addition to storing the current pulse, the subroutine checks PULSE DATA to detect the occurrence of an irregular pulse pattern which will be taken by the subroutine as indicating that the transmitter has been turned off. Various predefined criteria may be used to define an irregular pulse pattern, such the occurrence of two consecutive invalid pulses (i.e., pulses having pulse duration outside the normal operating range of 1.0 to 2.0 ms), or an average pulse rate during the next previous 250 ms that is more than 10% greater or 10% lesser than an average normal pulse rate. In that regard, an average normal pulse rate may be determined during program initialization, for example, or it may be preprogrammed (e.g., the reciprocal of the 15 ms pulse interval previously mentioned, or 66.67 pulses per second).

If the current pulse stored at block 62 is a brake pulse, the subroutine takes the action indicated at block 63. In other words, the subroutine sets a flag upon the occurrence of sufficient pulses to indicate a continuous brake command (i.e., the throttle trigger being held fully forward continuously for a predetermined turnoff time). For that purpose, the subroutine checks the duration of the current pulse. If the current pulse is a full brake pulse (e.g., with 10% of full brake, indicated by a 1.0–1.1 ms pulse), the subroutine starts TIMER if TIMER is not already running. TIMER is a real time, program-implemented timer, and the subroutine checks TIMER each time a full brake pulse is received to see if TIMER has reached the predetermined turnoff time (e.g., 5 seconds). When TIMER reaches the predetermined turnoff time, the subroutine sets FLAG (a programming flag).

However, if the pulse stored at block 62 is a drive pulse (i.e., a duration of 1.5–2.0 ms), the subroutine takes other action as indicated at block 64. In the event of a drive pulse, the subroutine checks to see if FLAG has been set for at least a predetermined reset interval (e.g., 250 ms) as indicated by another timer labelled FLAG RESET TIMER. If FLAG has been set for at least that long, the subroutine resets the FLAG and TIMER.

The reason for FLAG RESET INTERVAL is to avoid the possibility of resetting FLAG and TIMER in response to a transmitter glitch occurring when the transmitter is turned off. Otherwise, the operator could hold the throttle trigger fully forward for 5 seconds or more and then turn off the transmitter, only to have a transmitter glitch cause the FLAG and TIMER to be reset before an irregular pulse pattern is established for turnoff purposes. The FLAG RESET INTERVAL avoids that possibility. However, if the operator holds the throttle trigger fully forward for 5 seconds or more, and then changes his mind about turnoff, he may still pull the trigger back to resume normal operation. As soon as the trigger is pulled back beyond the neutral position for at least 250 ms, FLAG and TIMER will be reset. Of course, this function may be achieved in other ways, such as requiring at least two drive pulses that are spaced apart by the predetermined reset interval or more before resetting FLAG and TIMER.

If the pulse stored at block 62 results in an irregular pulse pattern (indicating that the transmitter has been turned off), the subroutine takes the action indicated at block 65. The subroutine first checks to see if FLAG is set. If it is, the subroutine turns off the receiver. Then, after performing the foregoing operations, the subroutine returns to the main program (block 56 in FIG. 3) as indicated at block 66 in FIG. 4.

Thus, the invention turns off the receiver by responding to a predefined pattern of throttle trigger manipulation. In other words, it recognizes a predefined pattern of throttle trigger setpoint information as a turnoff command. That technique works with existing R/C transmitter units. It avoids the need for a separate turnoff signal and an additional channel for communicating the turnoff command. The operator need only manipulate the throttle trigger as required to produce the predefined pattern.

Although the foregoing describes and illustrates an exemplary embodiment, one of ordinary skill in the art may make many changes, modifications, and substitutions without necessarily departing from the spirit and scope of the invention. Many other programming steps may be employed in the place of those described, for example.

What is claimed is:

1. A method of turning off the receiver of a radio controlled model, comprising:

providing a speed controller with control circuitry for receiving setpoint information from a receiver that represents manipulation of a throttle trigger on a transmitter unit and for automatically turning the receiver off upon the occurrence of a predefined pattern of setpoint information;

monitoring the throttle trigger setpoint information with the control circuitry;

detecting with the control circuitry the occurrence of the predefined pattern of the throttle trigger setpoint information; and turning off power to the receiver with the control circuitry upon the occurrence of the predefined pattern of throttle trigger setpoint information;

wherein the predefined pattern of throttle trigger setpoint information includes throttle trigger setpoint information corresponding to a full brake signal for a predefined period of time substantially greater than usually occurs in normal radio controlled model operation, followed by a cessation of the throttle trigger setpoint information corresponding to the transmitter unit being turned off.

2. A method of turning off the receiver of a radio controlled model, comprising:

providing a speed controller with control circuitry for receiving setpoint information from a receiver that represents manipulation of a throttle trigger on a transmitter unit and for automatically turning the receiver off upon the occurrence of a predefined pattern of setpoint information;

monitoring the throttle trigger setpoint information with the control circuitry;

detecting with the control circuitry the occurrence of the predefined pattern of the throttle trigger setpoint information; and turning off power to the receiver with the control circuitry upon the occurrence of the predefined pattern of throttle trigger setpoint information.

3. A method of turning off the receiver of a radio controlled model, comprising:

providing a speed controller with control circuitry for receiving setpoint information from a receiver that represents manipulation of a throttle trigger on a transmitter unit and for automatically turning the receiver off upon the occurrence of a predefined pattern of setpoint information;

monitoring the throttle trigger setpoint information with the control circuitry;

detecting with the control circuitry the occurrence of the predefined pattern of the throttle trigger setpoint information; and turning off power to the receiver with the control circuitry upon the occurrence of the predefined pattern of throttle trigger setpoint information;

wherein the predefined pattern of throttle trigger setpoint information includes throttle trigger setpoint information corresponding to the absence of a drive signal for a period of time no less than a predefined period.

4. A method of turning off the receiver of a radio controlled model, comprising:

providing a speed controller with control circuitry for receiving setpoint information from a receiver that represents manipulation of a throttle trigger on a transmitter unit and for automatically turning the receiver off upon the occurrence of a predefined pattern of setpoint information;

monitoring the throttle trigger setpoint information with the control circuitry;

detecting with the control circuitry the occurrence of the predefined pattern of the throttle trigger setpoint information; and turning off power to the receiver with the control circuitry upon the occurrence of the predefined pattern of throttle trigger setpoint information;

wherein the predefined pattern of throttle trigger setpoint information includes throttle trigger setpoint information corresponding to the absence of a drive signal for a period of time no less than a predefined period, followed by a cessation of the throttle trigger setpoint information corresponding to the transmitter unit being turned off.

* * * * *